US005743049A

United States Patent [19]

Thallemer

[11] Patent Number: 5,743,049

[45] Date of Patent: Apr. 28, 1998

[54] SUPPORT STRUCTURE FOR ARCHITECTURAL SYSTEMS

[75] Inventor: Axel Thallemer, Esslingen, Germany

[73] Assignee: Festo KG, Esslingen, Germany

[21] Appl. No.: 836,397

[22] PCT Filed: Oct. 26, 1995

[86] PCT No.: PCT/EP95/04214

§ 371 Date: May 9, 1997

§ 102(e) Date: May 9, 1997

[87] PCT Pub. No.: WO96/15344

PCT Pub. Date: May 23, 1996

[30] Foreign Application Priority Data

Nov. 11, 1994 [DE] Germany ..... 9418076 U

[51] Int. Cl.[6] ..... E04H 1/12; E04H 15/20

[52] U.S. Cl. ..... 52/2.21; 52/2.11; 52/2.17; 52/2.18

[58] Field of Search ..... 52/2.21, 2.18, 52/2.17, 2.13, 2.11

[56] References Cited

U.S. PATENT DOCUMENTS

| | | | |
|---|---|---|---|
| 1,964,818 | 7/1934 | Hood . | |
| 4,156,330 | 5/1979 | Fraioli . | |
| 4,685,257 | 8/1987 | Richter . | |
| 5,195,638 | 3/1993 | Zinbarg | 52/2.21 X |

FOREIGN PATENT DOCUMENTS

| | | |
|---|---|---|
| 0 403 981 A2 | 12/1990 | European Pat. Off. . |
| 940.236 | 12/1948 | France . |
| 2 341 017 | 9/1977 | France . |
| 2 344 784 | 10/1977 | France . |
| 3240501 A1 | 3/1984 | Germany . |
| 14957 | 8/1895 | United Kingdom . |

*Primary Examiner*—Robert Canfield

*Attorney, Agent, or Firm*—Hoffmann & Baron, LLP

[57] ABSTRACT

A support structure for architectural systems is suggested which comprises a plurality of supports (2) standing on a base and serving to bear a load. The supports (2) are constituted by air-tight hollow bodies (6) which possesses a wall of flexible material and are charged with compressed air in order to have a rigid form.

26 Claims, 4 Drawing Sheets

Fig. 6
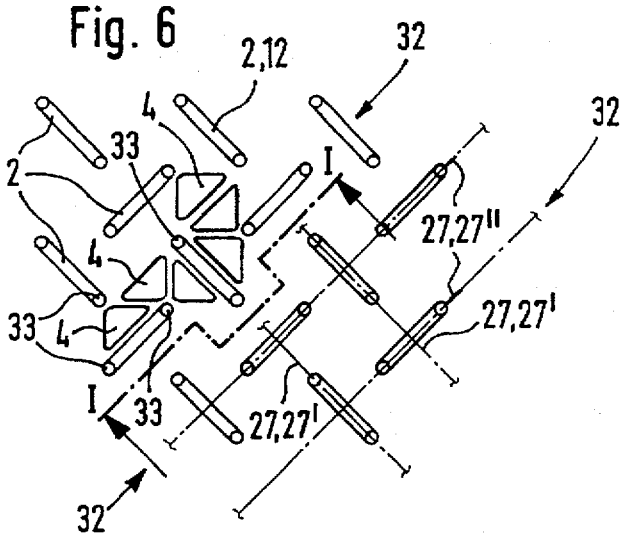
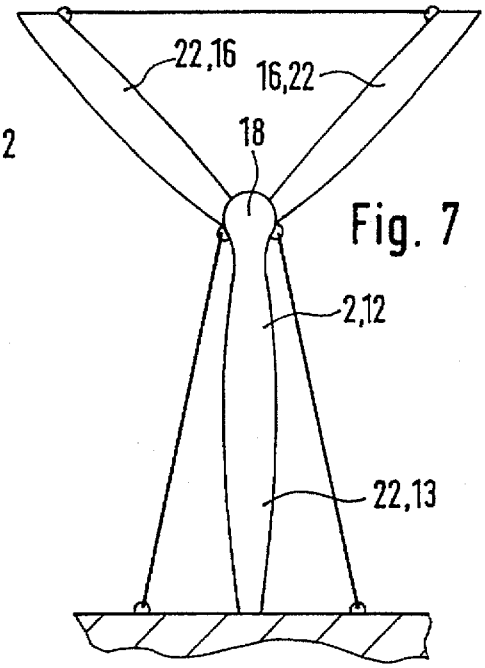
Fig. 7
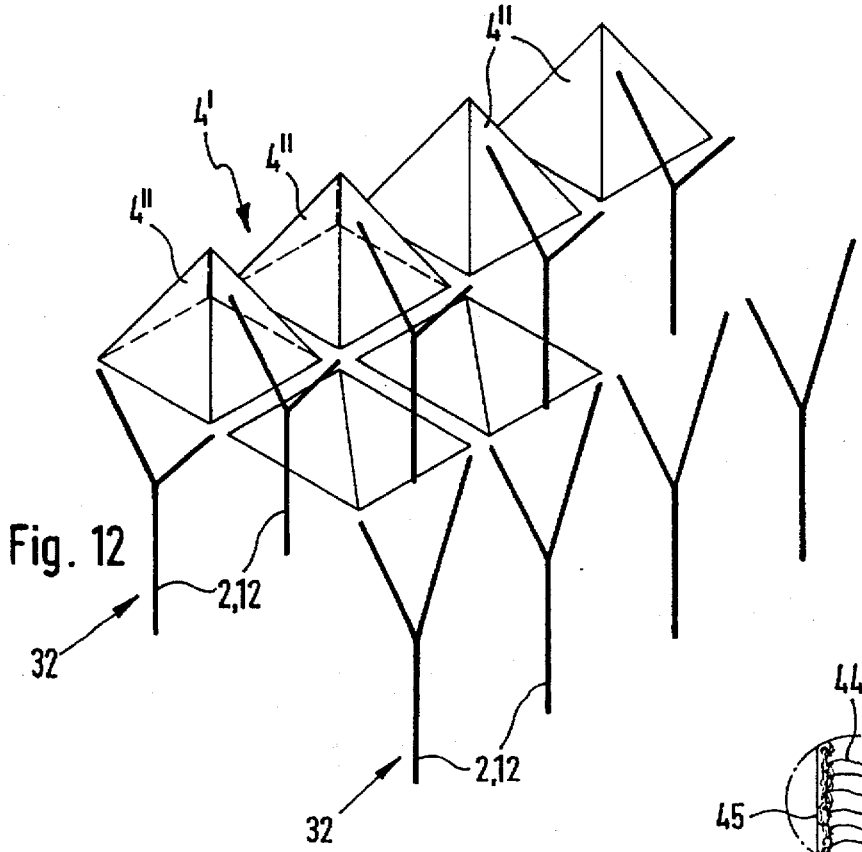
Fig. 12
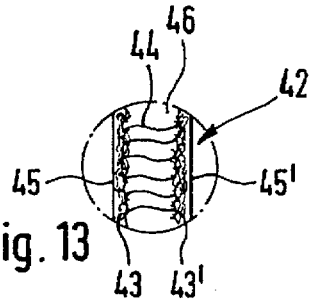
Fig. 13

SUPPORT STRUCTURE FOR ARCHITECTURAL SYSTEMS

BACKGROUND OF THE INVENTION

The invention relates to a support structure for architectural systems, more particularly for the erection of building structures such as edifice-like entities, trade fair booths, roofs or the like, comprising a plurality of supports standing on a base and serving for supporting a load.

In architectural systems such support structures are mostly a part of a building construction which withstands the effects of continuous loads, traffic and/or working loads and transfers same to the base. In the case of the erection of edifice-like entities, trade fair booths or sheltering roofs the base is normally in the form of the ground, which may be outdoors or within a building. As supports rods of wood, concrete or steel are employed, which transfer the load from the top to the bottom end. The supports should as far as possible be resistant to compression, buckling and flexure forces.

So far the erection of supporting structures has been relatively complicated and, owing to the relatively great weight of the support, difficult to perform and in some cases dangerous as well. Supporting structures, which are only erected temporarily and must be shipped to one site of use to another in turn, require much shipping space, even if the individual supports may be taken apart.

OBJECT AND SUMMARY OF THE INVENTION

One object of the present invention is to provide a support structure, which may be simply handled and whose individual parts require little shipping and storage space.

In order to achieve this object there is a provision such that the supports are constituted by air tightly sealed hollow bodies which comprise a wall of flexible material and in order to maintain a stiff structure are charged with compressed air.

It is in this manner that a supporting structure is produced, whose supports are constituted by pneumatic bodies. The shipping and storage thereof may be carried out in the pressure-less condition, the flexible walls of the hollow bodies rendering it possible to fold up the supports. The supports can assume their final shape on site because they are inflated with compressed air there. The internal pressure of the hollow bodies ensures a generally stiff structure, the weight of the individual supports being on the whole relatively low so that they may still be handled in the inflated state. While it would be possible to charge the individual supports in the factory with the intended volume of compressed air and then to hermetically seal off the hollow bodies after this, it is preferred for the supports to possess suitable filling openings, which in accordance with requirements render possible pumping up or discharge. Furthermore in this case by ad hoc pressurization it is possible to take into account the respective load applying.

Further advantageous developments of the invention are defined in the dependent claims.

It is convenient for all supports to be designed in the form of pillars, which preferably at least partly possess a vertical support column, whose bottom end bears on a base and whose top terminal region has two cantilever arms on it, which extend obliquely, i.e. laterally and at the same time upward, preferably in such a manner that the pillar is forked in the top part and generally has the form of a letter Y.

In order to provide a secure placement of the support it is preferably mounted on a foot part, which may be attached to the base.

The supports charged with compressed air mostly bear compression forces. In order to bear tensile forces as well, it is recommended for the supports to be stayed on the base using flexible traction elements such as cables. Furthermore any cantilever arms present on a respective pillar are preferably connected to one another by such traction elements.

In the case of a design which is particularly simple and therefore low in price the individual components of the supports or, respectively, pillars are preferably designed as cylindrical longitudinal elements. The cross section is in this case more particularly circular. An optimized transfer of compression forces is however to be expected, if the longitudinal elements are concentrically convex, that is to say have an entasis or bulge such that their diameter smoothly increases from the terminal regions toward the middle.

Handling and assembly is particularly simple, if each respective pillar is composed of a coherent component and preferably represents a single-part structural unit. In this case it is generally sufficient to have one charging opening through which compressed air may be passed in the desired amount.

In the case of a more universal design, which offers better adaptation to practical requirements, each respective support is composed of a plurality of individual hollow body components, which may be put together on site in a detachable manner. Contiguous hollow body longitudinal elements are in this case preferably connected using node elements, which possess sockets, into which the longitudinal elements may be plugged. On inflation of the hollow longitudinal elements there is then an automatic non-positive bracing effect so that no additional connecting means are necessary.

For the attachment of loads to be borne the supports preferably possess attachment means, which may be designed in the form of eye elements so that a linking together by means of conventional connecting element such as belts or cables may be performed.

A load to be borne may be constituted by a roof which is made up of the individual roof elements, which are secured to the supports. In this case it may be more particularly a question of sheet-like roof elements, which for example have a triangular outline. Like the roof elements the roof elements are also conveniently in the form of air-tight hollow bodies subject to an internal pressure.

Furthermore it is possible for wall or floor elements to be present on the support structure, which possess a sheet-like form and also may be designed in the form of air-tight hollow bodies charged with compressed air. With the aid thereof it is possible for more particularly completely closed building structures to be erected.

As a material for the supports flexible plastic material is more particularly provided, which has a sufficient bursting strength. In this case it is more especially to be recommended to utilize plastic material as for instance Aramide fiber reinforced nylon. In the case of a preferred design the supports are manufactured of a plastic fabric, which on at least one and more particularly both sides is provided with a gas-tight coating. For the roof wall and floor elements a so-called dual wall plastic fabric is more particularly employed, in the case of which two plastic fabric walls are joined together by threads so that there is a certain amount of intermediate space. Accordingly more particularly such hollow bodies may be produced, which in the condition under pressure have a high dimensional accuracy so as to have large-area, ceiling, wall and floor elements, which possess comparatively flat baseo faces and hardly bulge outward.

It is to be recommended to collect together a plurality of the supports of the support structure and/or any roof, wall and floor elements to form pneumatic compound groups and to connect same together for fluid flow therebetween. It is in this manner that the number of the connection points for compressed air may be reduced. To create a fluid flow connection it is possible to utilize simple flexible pressure fluid lines, which may be detachably connected with couplings on the hollow bodies, such couplings more particularly being of the plug in type.

If the hollow body elements of the support structure are permanently connected with a source of pressure medium, it is then recommended to provide an intermediate pressure regulation valve. It would also be possible to associate the individual supports with relief valve to let off air when the pressure becomes excessive.

BRIEF DESCRIPTION OF THE DRAWINGS

In what follows the invention will be described with reference to the accompanying drawings.

FIG. 6 is a plan view of the arrangement in accordance with FIG. 1 in a diagrammatic representation, the chained line I—I corresponding to the view shown in FIG. 1.

FIG. 7 shows a further design of a support of a support structure.

FIG. 12 shows a still further arrangement of a support structure using pyramidal roof elements.

FIG. 13 shows a cross section taken through the wall of a roof element as the fragment XIII in FIG. 2.

DETAILED DESCRIPTION OF THE PREFERRED EMBODIMENTS

Figure 1:
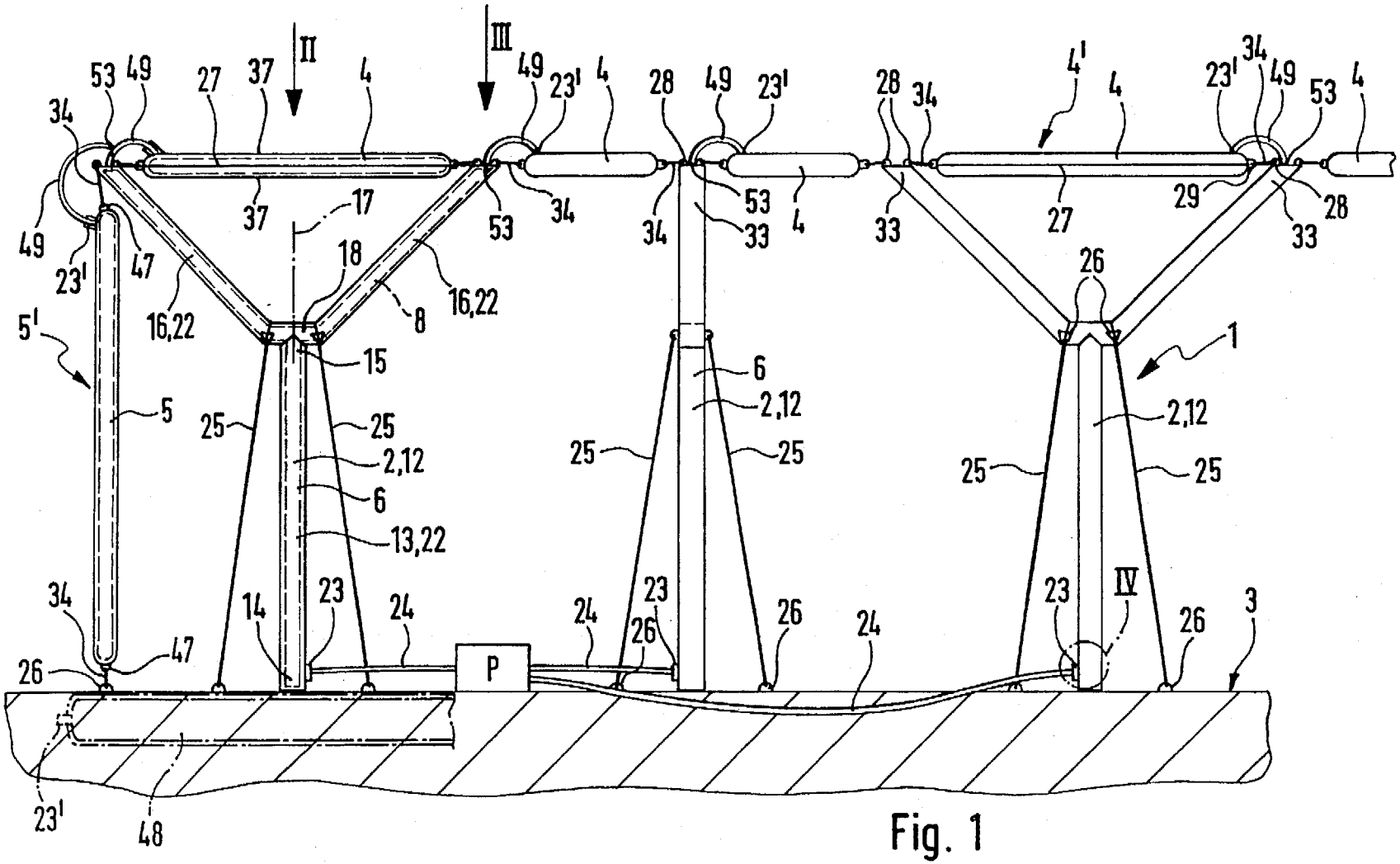
FIG. 1 shows a part of a support structure in accordance with a first embodiment of the invention, same including roof and wall elements as the load to be carried additional, optional floor elements being indicated in chained lines.

FIGS. 1 through 6 show a building structure in the form of a trade fair booth, which comprises one possible design of the support structure 1 of the invention.

Said support structure 1 comprises a plurality of supports 2 standing upright adjacent to one another on a base 3. The base 3 is in the present case the floor of a trade fair hall. The spatial distribution of the supports 2 on the base 3 is best to be seen in FIG. 6.

The supports 2 serve to take up the load. In the present example two forms of loads are involved which are borne by the supports 2. The one type of load is presented by a roof 4' constituted by a plurality of roof elements 4 and carried on the top ends of the supports 2 and extending over and clear of the base 3 in the form of a sheet. In FIG. 6 only some of the roof elements 4 are illustrated in order to render the drawing more straightforward, such elements having a sheet-like shape and in the present case having a triangular outline. They could also be described as plate-like or slice-like elements.

A further type of load is presented by one or more wall elements 5, which may be employed for the formation of partition or side walls 5' and which extend vertically between the top end of the respective support and the base 3.

An essential feature of the supports 2 is that same consist of air-tight hollow bodies 6 whose wall 7 (FIGS. 4 and 5) is manufactured of flexible material and which in order to maintain a stiff structure are charged with compressed air. Each support 2 is consequently an inflated flexible hollow body, which, when its interior space 8 is emptied of air may be folded up without any difficulty in order to have the very minimum volume for shipping and storage.

The supports 2 of the present example are designed in the form of pillars 12. In the preferred design same comprise a vertical support column 13 with a linear extent, whose bottom end 14 stands on the base 3. At the top terminal region 15 of the support column 13 there are two cantilever arms 16 with a linear shape, same extending both laterally to the outside and at the same time upward, the distance thereof from the upright axis 17 of the support column 13 increasing with an increase in height. The obliquely extending cantilever arms 16 are symmetrical in relation to the upright axis 17 so that they are diametrally opposite one another and the pillar 12 generally possess a Y-like shape. The pillar 12 consequently bifurcates in the top terminal region 15.

In order to produce an optimum connection between the support column 13 and the two cantilever arms 16 an intermediate node element 18 is preferably placed, which in the case of FIG. 1 is a short, horizontally extending transverse element.

Each pillar 12 is generally designed in the form of a permanently coherent or permanently assembled component. The hollow longitudinal elements 22 constituted by a respective support column 13 and the cantilever arms 16 are preferably integrally joined together so that they jointly delimit a hollow space or, respectively, interior space 8 extending over all longitudinal elements 22. The interior space 8 is closed in an air-tight fashion.

On each pillar 12 a charging and venting opening 23 is provided. It opens into the interior space 8 and renders possible the connection of, for example, a hose-like pressure medium line 24, which is connected with a source P of pressure medium. The latter can for example be a compressor. It is in this manner that the hollow supports 2 may be fully inflated with air under gage pressure. The compressed air serves to ensure that the elements, which have so far been limp, may assume a stiff condition suitable for carrying a load.

After charging the pillars 12 with compressed air the source of pressure medium may be removed. Simultaneously the charging and venting openings 23 are sealed so that unintended escape of compressed air is out of the question. Each charging and venting opening 23 is preferably provided with a check valve not illustrated in detail, which automatically closes when the pressure medium line 24 is disconnected, the opening then being sealed off. For dismounting the support structure 1 the check valves may be manually opened so that the compressed air may escape.

It will be clear that separately arranged charging and venting openings are also possible. Furthermore there may be a provision such that the source P of pressure medium is constantly connected with the interior space 8 in the pillars 12 in order to compensate for any leakage. In this case it is however to be recommended to provide the intermediate connection of so-called pressure reducing or pressure regulating valves. Furthermore it would be feasible to only have one or more selected pillars 12 directly connected with the source of pressure medium whereas the remaining ones would be supplied via such pressure medium lines as are connected with those pillars which are in direct communication with the source P of pressure medium.

In order to firmly set the individual pillars 12 in place, in the embodiment of the invention they are stayed in relation to the base 3. Flexible traction elements 25, preferably cables, are attached to the top region of each pillar 12 and extend obliquely downward, the bottom ends thereof being connected with the base 3. For attachment use is made at either end of attachment means 26 in the form of eye elements, which are arranged both on the pillar 12 and only on the base 3. In the present example each pillar 12 is stayed or braced with four traction elements 25, which on the pillar are attached in the node (18) region.

In order to prevent the bifurcated top terminal region of the pillar 12 from splaying out under load, the two cantilever arms 16 of each pillar 12 are held together by means of a horizontally extending flexible traction element 27. Again it is preferably a question of cable. They are also preferably joined with more especially eye-like attachment means 28, which in this case are located adjacent to the free end of the cantilever arms 16.

In the case of a building structure with a large number of pillars 12, it is possible to provide an array of traction elements 27, in the case of which individual continuously extending traction elements 27 are employed for simultaneously staying or bracing the cantilever arms 16 of a plurality of pillars 12. In the case of the arrangement illustrated in FIG. 6 the traction element array comprises two sets of mutually parallel traction elements 27' and 27", which intersect and which at the ends are best fixed to an external holder which is fixed as for example on the wall of the hall or is fixed in some other manner to the base 3. Such a cable system endows the support structure with a high transverse strength as compared with arrangements, in which separate traction elements 27 are provided separately connected with each pillar 12.

FIG. 6 shows in plan view a preferred distribution of the supports 2 or, respectively, of the pillars 12 for the erection of roofed trade fair booth. Several pillars 12 are respectively provided in mutually parallel rows 32, the pillars 12 within any given row 32 being arranged skewed through 90° one after the other about the upright axis 17 in such a manner that the plane defined by the two cantilever arms 16 of each pillar 12 extends in parallelism to and at a right angle to the respective row direction. The arrangement is furthermore such that adjacent pillars 12 of adjacent rows 32 are also arranged with a 90° offset so that, for example, a longitudinally aligned pillar 12 of a first row is opposite to a transversely aligned pillar 12 of the next row. In the case of such an arrangement there is an optimum positioning of the top free terminal regions 33 of the cantilever arms 16 in order to attach roof elements 4 with a triangular outline, it being possible for the individual free terminal regions 33 to be employed for the attachment of several roof elements 4.

Figure 2:
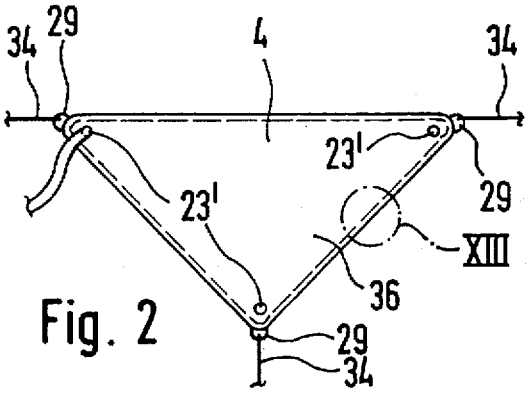
FIG. 2 is a plan view of the arrangement in accordance with FIG. 1 as indicated by the arrow II adjacent to a roof element.
Figure 3:
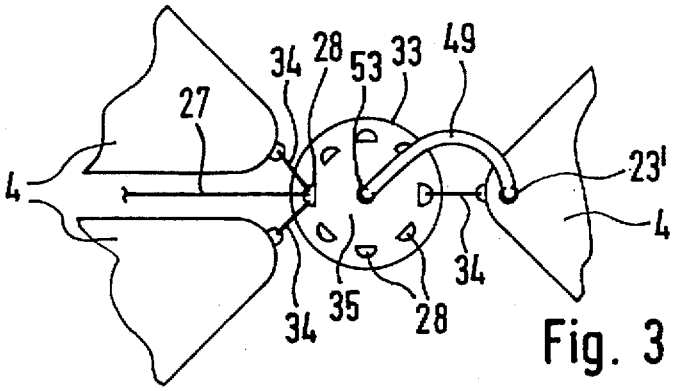
FIG. 3 is a plan view of the arrangement in accordance with FIG. 1 as indicated by the arrow III looking toward the end side of a cantilever arm.
Figure 4:
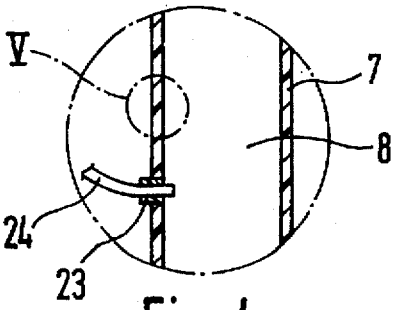
FIG. 4 shows the fragment IV, marked in FIG. 1, of a support in longitudinal section and on a larger scale.
Figure 5:
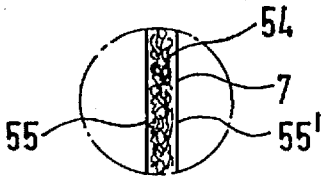
FIG. 5 shows the fragment marked V in FIG. 4 of the wall of the support on a larger scale.

In FIG. 2 such a roof element 4 is illustrated in plan view. It possesses an essentially sheet-like shape with a triangular outline, it preferably being in the form of an equilateral triangle. The three corner regions constitute attachment points, on which, for example, eye-like attachment means 29 are arranged. Using connecting members 34, as for example straps, cables or chains, the roof element 4 is connected with each attachment point at one free terminal region 33 of a cantilever arm 16. The connection members here have one end connected with the attachment means 29 and the other end connected with the above mentioned attachment means 28 of the cantilever arms 16. In accordance with FIG. 3 at its free terminal region 33 and more especially at its end wall section 35 each cantilever arm 16 possesses a plurality of attachment means 28, which for example are arranged on a circularly arcuate line, and which as required may be utilized for the attachment of connecting members 34 or traction elements 27, 27' and 27".

In the case of the embodiment of the invention depicted in FIGS. 1 through 6 the roof elements 4 are, like the supports 2, formed by air-tight hollow bodies 36, which possess a flexible air-tight wall and are inflated with compressed air. In order to ensure, despite the internal pressure, that the desired sheet-like shape is maintained and the two opposite large-area wall sections 37 possess an essentially planar form, the wall material of the roof elements 4 is preferably a dual wall plastic fabric. An example of a wall structure of this type is illustrated in FIG. 13.

The dual wall plastic fabric 42 FIG. 13 comprises two mutually parallel, spaced apart fabric walls 43 and 43' of woven plastic fibers, the two fabric walls 43 and 43' being joined together by woven-in connecting threads 44. The fabric walls 43 and 43' and the connecting threads 44 are preferably in the form of a single plastic fabric unit. The outer faces of the two fabric walls 43 and 43' may possess a coating 45 and 45' in order to obtain particularly air-tight properties. A laminated foil design and/or a rubber coating would be possible. The intermediate space 46 crossed over by the connecting threads 44 between the two fabric walls 43 and 43' may if required be filled with some suitable material, as for example with solids or with curing compounds.

To the extent that wall elements 5 are present, which are employed to form side walls and/or partitions, same preferably have the same design as the roof element 4, only the outline being different if desired in order to meet the respective requirements.

Like the roof elements 4 as well the wall elements 5 are secured to the top attachment means 28 of the cantilever arms 16. As illustrated at the left hand edge in FIG. 1, the wall elements 5 are preferably so aligned that the plane in which same extend runs vertically, attachment means 47 being provided at the peripheral edge, which may be eye-like for instance, in order, using connection members 34 of the type described, to provide for joining to the attachment means 28 of the cantilever arms 16. It is in this manner that the wall elements 5 are supported on the pillars 12, same being preferably guided on the base 30, something which again may be ensured using eye-like attachment means 26 and flexible connection members 34.

The base 3 in the embodiment of the invention is a solid floor. In case of need it may however be constituted by one or more pneumatic bodies. In FIG. 2 one floor element 48 is illustrated in chained lines, whose design is in principle the same as that of the roof elements 4 and the wall elements 5, such elements also being in the form of flexible hollow bodies subject to an internal pressure. It is possible for several such floor elements 48 to be arranged in one plane alongside one another and linked together using attachment and connecting means in order to make up a base 3 of any desired extent.

The above mentioned roof, wall and floor elements 4, 5 and 48 preferably possess at least one charging and venting opening 23', via which the necessary compressed air may be supplied to obtain the necessary turgidity and which renders venting possible, when the individual elements are folded or rolled up in a space saving fashion when not in use. Each element 4, 5 and 48 may be directly connected with a pressure medium source. It is however simpler to adopt the design of the example, wherein the supports 2, connected with the pressure medium source P, are connected via more particularly hose-like pressure medium lines 49 with the said elements 4, 5 and 48 for fluid flow therebetween so that there is a pneumatic compound structure, the said elements 4, 5 and 48 being supplied with compressed air from the supports 2. At a suitable point the supports 2 consequently possess connection ports 53 for linking with one or more pressure medium lines 49, which at the other end are connected with the charging and venting opening 23' of the next element 4, 5 and 48. Preferably the connection ports 53 and the charging and venting openings 23 and 23' are fitted with plug-in coupling means, which render possible rapid connection and disconnection of the pressure medium lines 49. The wall, roof and/or floor elements may be also connected together pneumatically using lines 49.

Not only the supports but also the roof, wall and floor elements 4, 5 and 48 may respectively possess charging and/or venting openings 23 and 23' and/or connection ports 53 in order to provide for maximum adaptability of connection. Thus for example the triangular roof elements 4 of the embodiment of the invention possess one charging and venting opening 23' in each corner region, which opening may be employed in case of need as connection ports 53. Moreover it is here only necessary to design one of the openings as a venting one which possesses a manually opening valve. All other openings are however preferably fitted with check valve means, not illustrated, rendering possible the supply of compressed air while preventing the escape thereof.

The wall 7 of the pillar-like supports 2 of the embodiment of the invention comprises a flexible plastic material. Preferably fiber reinforced material is utilized. It has been found to be recommendable to adopt the design depicted in FIGS. 4 and 5, in accordance with which the wall 7 is manufactured of plastic fabric, which comprises a fabric wall 54 of woven plastic fibers, such wall 54 preferably being provided with an air-tight coating 55 and 55' on either side. The fabric wall 54 is produced using conventional weaving technology.

In the case of the designs in accordance with FIGS. 1 through 6 both the support column 13 and also the two cantilever arms 16 have a cylindrical external shape with at least approximately the same diameter along the full length thereof. They can accordingly be termed cylindrical longitudinal elements 22. A design with better statics and which can resist higher load forces is illustrated in FIG. 7. The hollow longitudinal elements 22 of the pillar 12 shown here possess a concentrically convex or bulging wall so that circular diameter of a respectively longitudinal element 22 continuously increases starting from each terminal region toward the middle of the length.

The support structure 1' depicted in FIGS. 8 through 11 differs from the those so far described essentially is as far as the individual pillars 12 are made up using several hollow body components 56 which are disconnectably assembled. The support column 13 and the cantilever arms 16 are designed in the form of such elongated hollow body components, which are each sealed to be air-tight and may be handled separately. The linking together of hollow body components 56, of which they are three in the embodiment of the invention, is preferably performed by means of a node element 18, which is illustrated in more detail in FIGS. 9 and 10. In the case of this node element it is a question of a solid body, more particularly manufactured of plastic material, which distributed about its periphery possesses a number of sockets 57 equal to the number of hollow body components 56. The angular spacing between the sockets 57 is equal to the spacing of the hollow body components 56. Each hollow body component 56 has its terminal region 58 plugged into the associated socket 57 so that the support column 13 is directed downward and the two cantilever arms 16 point obliquely upward.

In the illustrated working embodiment of the invention there is a simple non-positive or frictional connection between the node element 18 and the inserted hollow body components 56 due to the internal pressure obtaining in the internal spaces 8 in the hollow body components 56. It is convenient for the hollow body components 56 to be inserted into the sockets 57 when the internal pressure is reduced, whereafter the internal pressure is increased so that the hollow body components 56 are frictionally braced in the sockets 57.

For the supply of compressed air it is possible in principle for all hollow body components 56 to be independently connected with a pressure medium source P. However it is simpler to adopt the design depicted in FIGS. 8 and 9, in which only one hollow body component 56, namely here the support column 13, is connected by a line 24 with the pressure medium source P, whereas the two other hollow body components 56 are pneumatically connected with the support column 13 and therefore receive compressed air by way of same.

The pneumatic connection may then be produced between a given cantilever arm 16 and the support column 13 by providing suitable connecting means 62, which are more particularly in the form of plug-in connection means. Thus the cantilever arms 16 may have terminal port-like male spigots 63 adapted to fit into complementary female holes 64 at the top end of the support column 13, when the individual components are plugged together. It would however also be possible to produce separate connections using pressure medium lines, as is the case in the production of the pneumatic array of part in the embodiment of the invention as illustrated in FIGS. 1 through 6.

A further possibility would be to connect additional hollow body elements on the hollow separate cantilever arms 16 as is indicated in FIGS. 1 through 6.

In the illustrated working embodiment in accordance with FIGS. 8 through 11 the load to be borne is constituted by roof elements 4, which are solid plates. The attachment thereof to the cantilever arms 16 is ensured using intermediately placed bearer elements 64, which are more especially plate-like and which are mounted on the terminal regions of the cantilever arms 16, the cantilever arms 16 having a top terminal region 33 thereof inserted into a socket 65 in the bearer part 64. The bearer parts 64 are more particularly frictionally or non-positively secured on the cantilever arms 16, for example using a sort of clip or clamping connection between the hollow body parts 56 and the thickened node element 18. For securing the roof elements 4 in position attachment means 66 are provided between the roof elements and respective bearer part 64, such attachment means being for example in the form of burr fasteners so that there is a detachable securing system.

Figure 8:
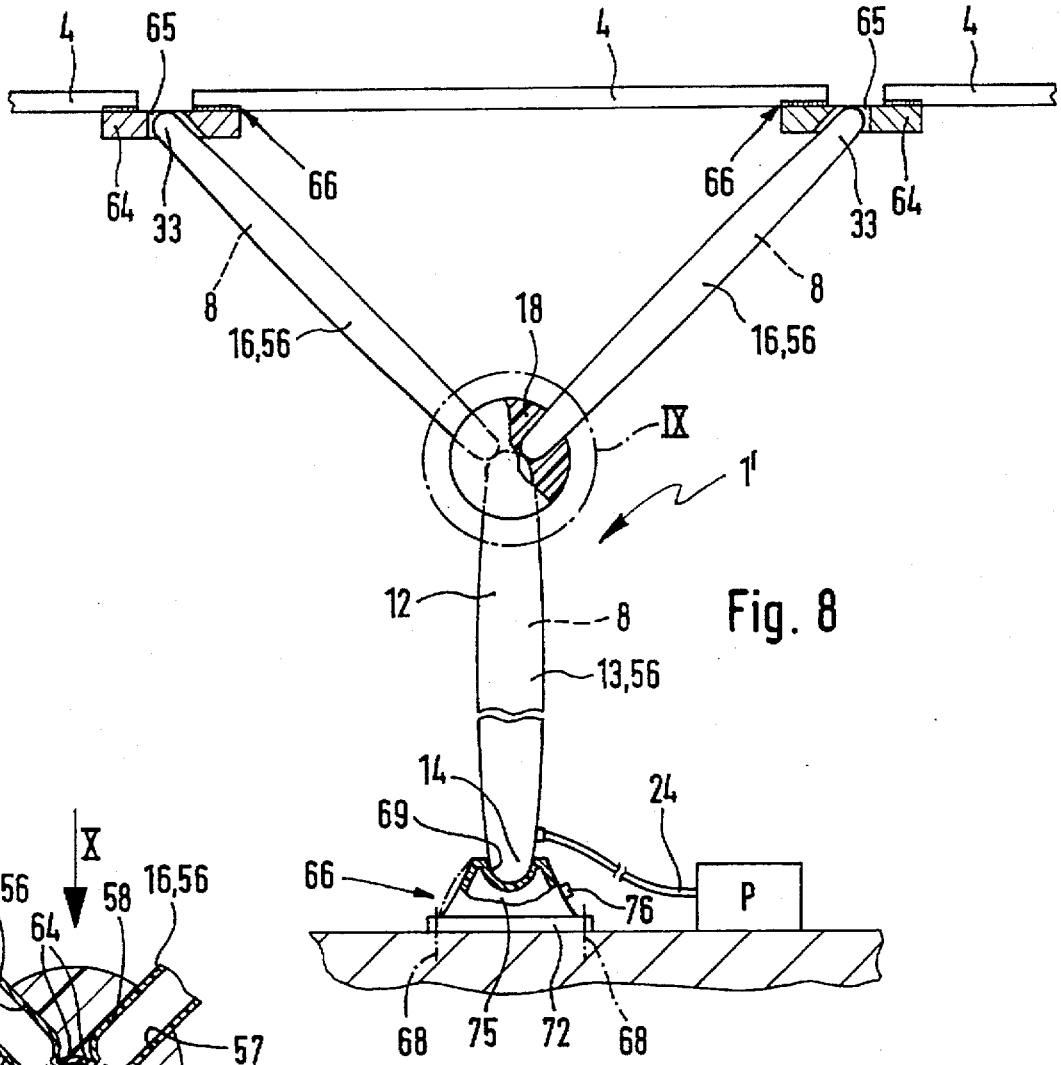
FIG. 8 also shows another design of a support of the support structure, same comprising a plurality of individual elements.
Figure 9:
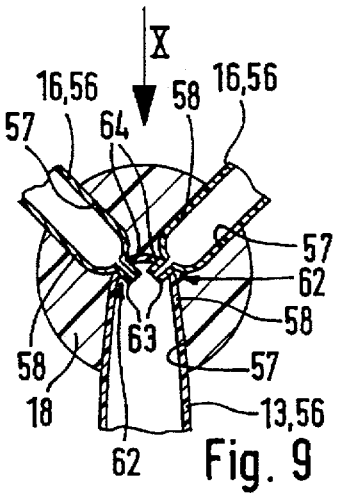
FIG. 9 shows the fragment IX marked in FIG. 8 in section and on a larger scale.
Figure 10:
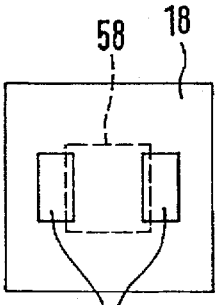
FIG. 10 shows a plan view of the node element illustrated in FIG. 9 as indicated by the arrow X.
Figure 11:
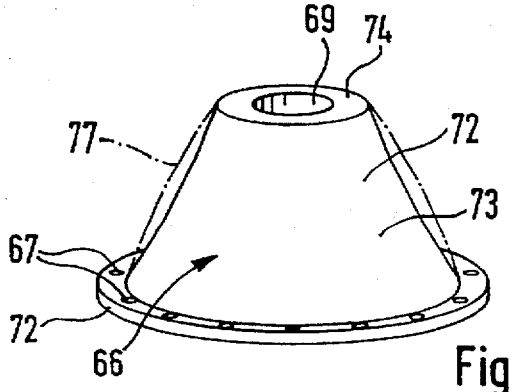
FIG. 11 shows the foot part employed in the embodiment in accordance with FIG. 8 separately and on a larger scale.

For reliably fixing a pillar 12 in relation to the base 3 it is possible to fix the bottom terminal region 14 of the respective pillar 12 in a foot part 66. Such a foot part 66 is illustrated in FIGS. 8 and 11. It possesses means 67 for attachment on the base 3, for example with the aid of a screw and screw receiving plug connection 68. The foot part 66 of the present example is designed in the form of a bowl and in the top side thereof there is a socket 69, into which the bottom end 14 of the pillar 12 is detachably plugged and thus laterally held.

It is preferred for the foot part 66 to be a hollow body filled with compressed air and whose wall 72 is at least partially flexible. In the illustrated working embodiment it possesses a relatively stiff or rigid bottom wall 72, which may be constituted by a circular disk and it is adjoined in the upward direction by a frustoconical portion 73, in whose top terminal wall 74 the socket 69 is molded or formed. In the interior of this structure an internal space 75 is provided, which through a suitable opening 76 may be charged with compressed air. At least the conical side wall is bendingly flexible so that under a load an outward bulging deformation is possible as is indicated in chained lines in FIG. 11 at 77.

FIG. 12 diagrammatically presents a further support structure arrangement. It comprises several parallel rows 32 of pillars, the pillars of any given row 32 having the same orientation, even though the relative alignment of adjacent rows is offset by 90° so that one given row 32 may have a longitudinal alignment whereas the next one has a transverse alignment. In this arrangement another type of roof element 4" is also employed, such elements being designed in the form of pyramids, more especially four-sided ones. These pyramidal roof elements 4" may be in the form of hollow bodies or of bodies with a flexible wall, which like the above described roof elements 4 are inflated with compressed air to bring them into their final shape.

Using the support structure in the embodiments it is possible to erect building structure with a wide variety of geometrical configurations. In this respect it may be a question of such structures standing by themselves or of structures erected within other buildings. It is more or less possible to provide a modular kit or set of elements comprising any desired number of supports, roof elements, wall elements and floor elements, which may be combined to provide the desired edifice-like entity. The elements not required are not inflated and remain in their space saving, folded up state.

What is claimed is:

1. A support structure for supporting a load with respect to a base, said support structure comprising:

a plurality of supports adopted to be positioned on the base and to support the load, each of said supports including a pillar, said pillar having a column, said column including:

a wall of flexible material forming a sealed air-tight hollow body having a diameter, a top region, a bottom region, and a longitudinal middle, wherein said hollow body is a substantially concentrically convex element wherein said diameter continuously decreases from said longitudinal middle toward said top and bottom regions and, wherein said hollow body being inflated resulting in stiffening of said column.

2. The support structure as defined in claim 1, wherein said pillar further comprise a plurality of cantilever arms which extend laterally and obliquely upward from said top region of said column.

3. The support structure as defined in claim 2, wherein said plurality of cantilever arms are concentrically convex longitudinal elements which are inflatable to assume a rigid form.

4. The support structure as defined in claim 2, wherein said pillar includes a node element in a transitional region formed between said column and said plurality of cantilever arms.

5. The support structure as defined in claim 2, wherein said column has an upright axis and said pillar includes a pair of cantilever arms, said pair of cantilever arms being diametrally opposite and arranged symmetrically with respect to said upright axis of said column.

6. The support structure as defined in claim 2, wherein each of said supports includes a horizontally extending traction element for bracing together said plurality of cantilever arms of said pillar.

7. The support structure as defined in claim 1, wherein each of said supports includes a plurality of flexible traction elements, said traction elements being attached between said top region of said column and the base for bracing said pillar.

8. The support structure as defined in claim 2, wherein said column and said plurality of cantilever arms are integrally joined as a permanently assembled component.

9. The support structure as defined in claim 1, wherein each of said supports further includes a foot part, said foot part having a socket for receiving said bottom region of said column.

10. The support structure as defined in claim 9, wherein said foot portion comprises a wall of flexible material forming a second hollow body, said second hollow body being charged with compressed air.

11. The support structure as defined in claim 1, wherein each of said supports include an attachment means on said pillar for attaching the load thereto.

12. The support structure as defined in claim 11, wherein said attachment means includes eye elements.

13. The support structure as defined in claim 1, further comprising an attached roof having a plurality of roof elements.

14. The support structure as defined in claim 13, wherein said roof elements have a sheet-like shape for attachment to said plurality of supports.

15. The support structure as defined in claim 14, wherein said roof elements have a substantially triangular outline.

16. The support structure as defined in claim 13, further comprising an attached wall and an attached floor.

17. The support structure as defined in claim 16, wherein said roof, wall and floor are formed of discrete air-tight hollow bodies charged with compressed air.

18. The support structure as defined in claim 17, wherein said roof, wall and floor are formed of dual wall plastic fabric.

19. The support structure as defined in claim 1, wherein said wall of said column is formed of reinforced plastic material.

20. The support structure as defined in claim 18, wherein said plastic fabric includes a gas-tight coating formed on at least one side thereof.

21. The support structure as defined in claim 1, wherein said hollow body includes an opening for the supply and discharge of compressed air, said opening having a check valve.

22. The support structure as defined in claim 21, further comprising:

a source of pressure medium, and a plurality of hose-like pressure medium lines for pneumatically connecting said hollow body of each of said supports together, wherein at least one support is continuously connected with said source of pressure medium.

23. A support structure for supporting a load with respect to a base, said support structure comprising:

a plurality of discrete interconnected air-tight hollow body components formed of a wall of flexible material, each of said hollow body components having:

a diameter;

a top terminal region;

a bottom terminal region; and a longitudinal middle, wherein each of said hollow body components is a substantially concentrically convex element wherein said diameter continuously decreases from said longitudinal middle toward said top and bottom terminal regions, and at least one of said hollow body components adapted to be positioned on the base, and wherein said hollow body components being inflatable resulting in stiffening of said support structure.

24. The support structure as defined in claim 23, wherein said plurality of discrete interconnected air-tight hollow body components are disconnectably assembled.

25. The support structure as defined in claim 24, wherein said plurality of discrete interconnected air-tight hollow body components comprise:

a column, said column being substantially vertical having said bottom terminal region standing on said base;

a plurality of cantilever arms, said cantilever arms having said bottom terminal regions linked to said top terminal region of said column and extending laterally and obliquely upward; and a node element linking together said column and said plurality of cantilever arms.

26. The support structure as defined in claim 25, wherein said node element is formed of a solid material having a plurality of sockets, and said top terminal region of said column being inserted in one of said plurality of sockets and each of said bottom terminal regions of said plurality of cantilever arms being inserted in one of said plurality of sockets, and wherein said column and said plurality of cantilever arms are frictionally braced within said plurality of sockets by an internal pressure within said hollow body components when said hollow body components are inflated.

* * * * *